United States Patent [19]

Nordqvist

[11] 3,990,566

[45] Nov. 9, 1976

[54] METHOD TO BE USED AT PACKAGING A NUMBER OF ARTICLES AND A DEVICE FOR EFFECTING THE METHOD

[75] Inventor: Jack Nordqvist, Kungalv, Sweden

[73] Assignee: Wikings Mekaniska Verkstad AB, Goteborg, Sweden

[22] Filed: May 9, 1974

[21] Appl. No.: 468,570

[30] Foreign Application Priority Data

May 16, 1973 Sweden ..... 7306893

[52] U.S. Cl. ..... 198/419; 198/420; 214/6 N; 53/159

[51] Int. Cl.[2] ..... B65G 47/26

[58] Field of Search ..... 198/235, 34, 29, 260, 198/30; 53/48, 159; 214/1 R, 6 R, 6 N, 6 P, 6 S

[56] References Cited

UNITED STATES PATENTS

| | | | |
|---|---|---|---|
| 2,470,795 | 5/1949 | Socke | 214/6 N |
| 2,571,790 | 10/1951 | Tomkins | 198/29 |
| 2,858,009 | 10/1958 | Bainbridge | 198/34 |
| 3,650,371 | 11/1969 | Constable et al. | 198/29 |
| 3,680,678 | 8/1972 | Ganz | 198/34 |

*Primary Examiner*—James B. Marbert
*Attorney, Agent, or Firm*—Holman & Stern

[57] ABSTRACT

When packaging round articles such as bottles, jars and the like, it is a desideratum that the articles be automatically arranged in such a formation so that the largest possible number of articles are brought together on a parallelepipedic base of a given size.

Such a formation — a scroll pattern formation — can be obtained in a most simple manner in using a method and nodwire by which the articles are formed to rows, which through a feed opening are fed to a surface at which the scroll pattern formation shall be obtained, said feed opening being adjusted between every row feeding operation so that it, after every second feed operation, is moved a step sidewise and after the other feed operations is moved to its original position.

5 Claims, 4 Drawing Figures

METHOD TO BE USED AT PACKAGING A NUMBER OF ARTICLES AND A DEVICE FOR EFFECTING THE METHOD

BACKGROUND OF THE INVENTION

When packaging round articles such as bottles, jars and the like in, large numbers in for instance, a shrinkable plastic foil, it is a desire that the articles are arranged in such a manner as to allow an optimum usage of a given rectangular space. In order to get such an optimum formation, the articles shall be placed in rows, each of which rows is displaced sideways a distance corresponding to the article radius in relation to the previous row. This formation will hereinafter be referred to as a scroll pattern formation.

The scroll pattern formation will cause the articles to be kept together in a better way, whereby they will support each other better and a more stable package is obtained.

SUMMARY OF THE INVENTION

The present invention now relates to a method used when packaging a number of articles of substantially round (circular) cross section and the method is intended for locating said articles in a substantially parallelepipedic formation with the articles arranged in a scroll pattern formation; a second aspect the invention relates to a device for effecting the method.

The method according to the present invention is characterized by the following steps of operation; transporting by means of a first transport device a number of articles to a collection station; arranging said articles in a straight row at said collection station; feeding one row of articles after another from the collection station through a feed opening onto a second transport device; transporting by means of said second transport device said rows of articles one by one against a stop adjusting the width of the feed opening so that the articles of a row of articles, fed through the feed opening, when transported against the stop, will hit the articles of a previous row fed immediately therebefore, at a point off set relative to the middle line of said previous articles, whereby said transported articles due to their movement, will find and occupy spaces between the articles of the previous row. The device for effecting the method is characterized by a first transport device in the form of a conveyor belt, a collection station arranged at one end of said first conveyor belt, a second transport device in the form of a conveyor belt arranged perpendicularly to the first conveyor belt and just in front of the collection station, a feed opening arranged between the collection station and the second conveyor belt, a reciprocating transfer means arranged to feed articles gathered in a row at the collection station over on said second conveyor belt, said second conveyor belt being provided with a stop arranged remote from the feed opening and further with side supports, the feed opening being provided with means enabeling an adjustment of the width of the feed opening in relation to said side supports.

DESCRIPTION OF THE PREFERRED EMBODIMENTS

Figure 1:
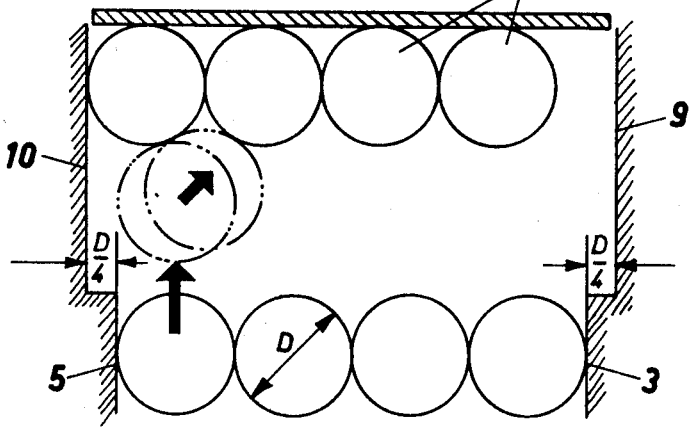
FIG. 1 illustrates diagramatically the apparatus and method according to the invention.

In the drawings, 1 indicates a number of articles which have a substantially round cross-section and which in at least one layer shall be arranged to constitute a parallelepipedic formation with the articles arranged in a scroll pattern. Prior to the feeding of the articles into a packaging machine, the articles must be brought together to groups (rows) and the devices shown on the drawings are intended to bring about such formation of groups. The articles are conveyed to the grouping station on a belt conveyor 2 which has such a width that the articles will stand in one row only.

At one end of the conveyor 2 there is arranged a stop, designed as a displaceable support 3, which extends outside the belt conveyor 2 and a short distance out over a second belt conveyor 4 arranged perpendicularly to the first conveyor. The second conveyor has a width somewhat exceeding the largest occuring width of the parallelepipedic formation to which the articles shall be grouped. The displaceable support 3 constitutes, together with a second displaceable support 5, which is arranged substantially parallel with the first support, two side walls of a feed opening 6 for the articles from the first conveyor belt 2. The second support 5 is shorter than the first one and extends along one of the front side edges only of the second conveyor. In front of the feed opening 6 there is arranged a partition 7 between the two conveyors, which partition is vertically adjustable to such an extent that it can be lowered to a level below that of the conveyors, whereby transfer from the first conveyor 2 to the second conveyor 4 can take place. The transfer is brought about by means of a displaceable plunger 8 or the like, which has substantially the same width as the feed opening 6 or somewhat smaller width than this.

Figure 2:
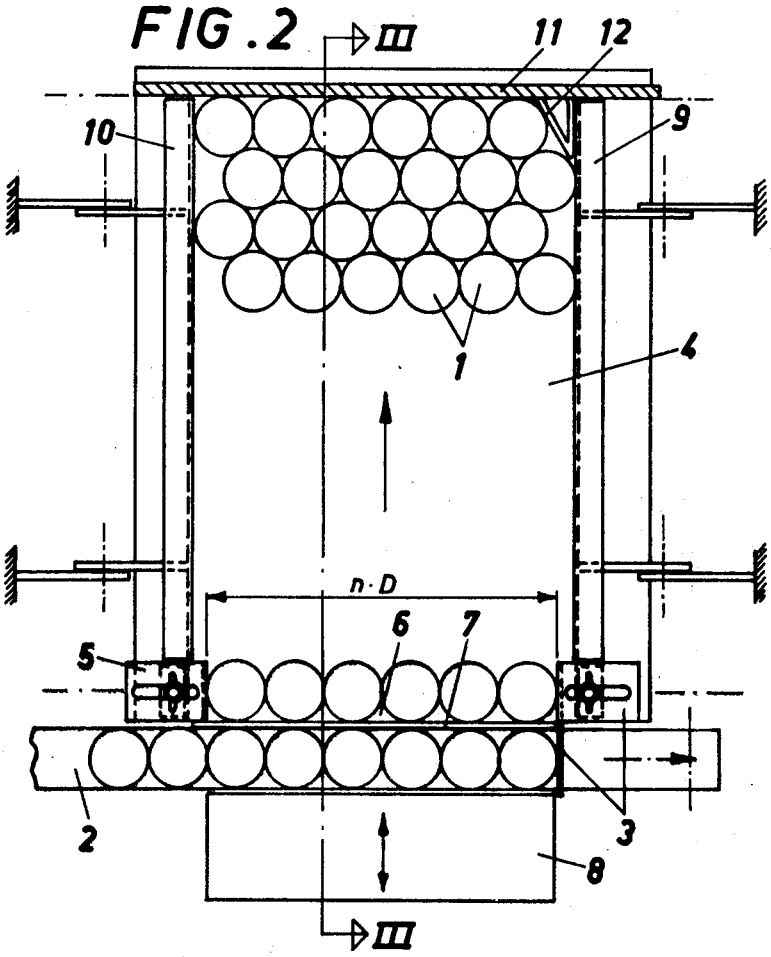
FIG. 2 shows in a top plan view on a reduced scale, the device according to the invention more in detail.
Figure 3:
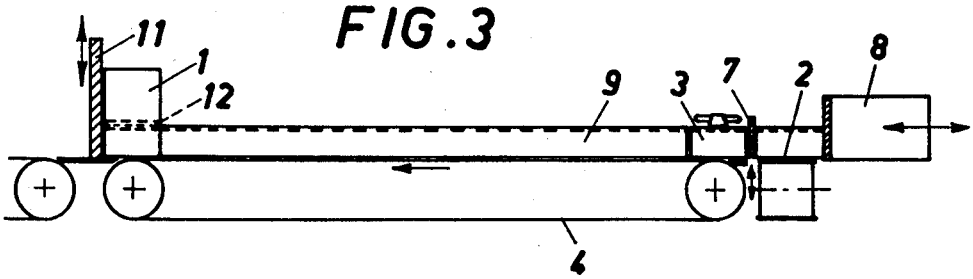
FIG. 3 is a vertical section of the device taken substantially on line III-13 III of FIG. 2.

The two supports 3 and 5 extend along the second conveyor a distance preferably corresponding to the diameter of one of the articles, and the conveyor belt 4 is at both side edges provided with displaceable side supports 9 and 10, to which the supports 3 and 5 are displaceably attached. At the end of the conveyor belt 4 remote from the feed opening there is arranged a vertically adjustable stop 11, which, when a sufficient number of rows of articles have been grouped on the conveyor 4, will be raised so much that the first row of articles will be released and the entire formation can be transferred to the next processing station. The side supports 9 and 10 can be displaced sideways in relation to the supports 3 and 5 which form the side walls of the feed opening, a distance corresponding to a quarter of the article diameter if the articles shall be arranged in a scroll pattern formation with an equal number of articles in each row. In order to get the first row to take up a correct position in relation to the subsequent rows, a triangular filling piece 12 is arranged in one of the corners between a side support 9, for instance, and the stop 11, which filling piece is designed to form an angle of 120° with the stop. The filling piece 12 is preferably connected to the stop 11. The device shown in FIGS. 2 and 3 operates as follows:

The articles, e.g. bottles 1, are conveyed in a single row on the belt conveyor 2 towards the support 3.

When the space on the conveyor belt in front of the feed opening 6 is filled with articles, the partition 7 will get an impulse, whereby it is lowered below the level of the conveyor belt, the plunger 8 at the same time receiving an impulse activating it to push the articles in front of the feed opening 6 onto the second conveyor belt 4. The side walls 3 and 5 of the feed opening 6 are so adjusted relative to the side supports 9 and 10 at the conveyor belt 4, so that a row of articles 1 will hit the articles of the preceeding row beside the middle line of these prior articles, whereby the articles just fed, due to the movement of the conveyor belt 4, automatically will seek out and occupy the spaces between the articles of the preceeding row. See FIG. 1.

Figure 4:
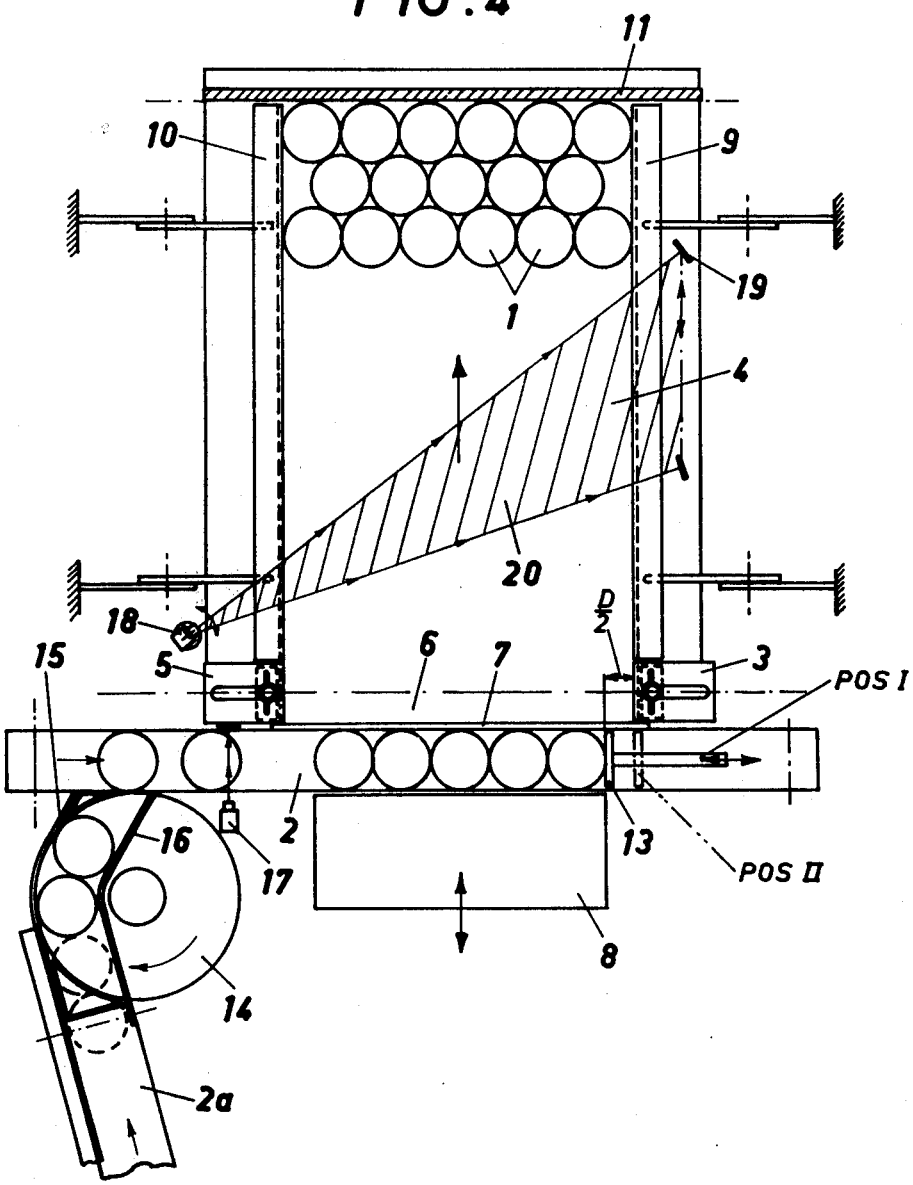
FIG. 4 shows in a view similar to FIG. 2 a modified embodiment of the device according to the invention.

By means of the above mentioned device, the articles are arranged in a scroll pattern formation with an equal number of articles in each row, but if a scroll pattern formation with an equal number of articles in each secnd row is desired, then the device according to FIG. 4 is used. The main components of the embodiment shown in FIG. 4 are designed mainly in the same manner as at the device according to FIGS. 2 and 3, with the exception that one of the side walls of the feed opening is constituted by a movable stop member 13, which is displaceable between two positions, thus that the stop member in one position — position I is located inside one of the side supports 9 or 10, respectively a distance corresponding to half the diameter of one article. At its second position — position II the stop member 13 is located in level with said side support whereby the entire feed opening in this position is free. The not shown drive of the stop member will receive an impulse when the plunger 8 is returned to its initial position beside the conveyor 2, thus that a change in position is achieved after each feed movement. The plunger 8 is designed with a length corresponding to $(n-1)$, i.e. to a length being one article less than the maximum number of articles in one row, and as the stop member 13 at every second time will be in position I, whereby the length of the feed opening is reduced by half the article diameter, then an article will be in front of the side support 10 and outside the length of the plunger 8, which means that each second row will become one article shorter than the previous row.

The device shown in FIG. 4 has further been equipped with an additional belt conveyor 2*a* which conveys articles to be packed via a transfer disc 14, which is rotatable and has to its purpose to transfer the articles from conveyor belt 2*a*. The additional conveyor belt 2*a* is driven at a velocity being lower than the velocity of the conveyor 2, which means that the articles, when transferred to the more rapid conveyor belt 2, will be spaced apart a short distance. The rotatable disc 14, which is provided with guide shields 15, 16 for directing the articles onto conveyor belt 2, is driven at the same speed as the additional conveyor 2*a*, but it is also possible to let the disc be non-driven whereby the articles when transferred from the additional conveyor to the disc will give the disc a rotational speed which is directly proportinal to that of the additional conveyor.

A first photocell 17 is arranged to scan a line over the conveyor belt 2 at a position just before the feed opening 6, and to give a stopping pulse to the drive means (not shown) for the conveyor belt 2 and 2*a* and for the rotatable disc 14 when a row of articles has been formed between the stop member 13 and the line scanned by the photocell 17. The stopping pulse is also used to activate the plunger 8 to push the row formed onto the second conveyor 4. The photocell 17 is set in such a way that it will give a pulse only when an article has stopped in the scanned area but not when the spaced apart articles pass through the scanned line. It is therefore important that the articles as mentioned hereabove are spaced apart a short distance on the conveyor belt 2 in order not to cause the photocell to give a stopping pulse indicating a full row of articles before an entire row of articles has been formed.

A second photocell 18 is arranged beside the second conveyor belt 4. Said second photocell 18 is adapted to work together with a reflector or a receiver 19 arranged diagonally on the opposite side of the second conveyor belt 4. The photocell 18 is pivotable and the reflector is movable and adapted to be locked at any desired position along a path extending along a part of the conveyor belt 4. The second photocell 18 and its reflector 19 can thereby be adjusted to scan any line within an area 20 of the conveyor belt 4 and this photocell arrangement is like the photocell 17 set to give an impulse only when the line scanned is broken during a time period by the articles to be packed. The row of articles moving with the conveyor belt 4 towards the stop 11 will however cause no impulse if only passing through the scanned line. The second photocell is arranged to give a signal when a row of articles has stopped in the scanned area and this signal tells subsequent packaging apparatuses when a complete parallelepipedic formation has been formed and the wrapping shall take place. During the time, when the second photocell 18 indicates articles, the plunger 8 is locked in its initial position even if the first photocell 17 indicates that a row is ready to be pushed over on the second conveyor belt 4. It is possible to adjust the number of rows of articles in the package to be formed due to the adjustability of the photocell 18 and its receiver 19.

The invention is not limited to the shown and described embodiments, but a plurality of variations are possible within the scope of the invention. Thus the articles may be fed in other ways and a plurality of articles may for instance be arranged upon each other.

What I claim is:

1. A method for assembling a number of articles having a substantially round cross-section and arranging said articles in a substantially parallelpipedic formation with adjacent rows of the articles arranged in a scroll pattern formation including the following steps: (A) transporting by means of a first transport device a number of articles to a collection station; (B) arranging said articles in a single straight row at said collection station; (C) feeding one row of articles after another from the collection station through a feed opening onto a second transport device disposed perpendicular to the first transport device; (D) successively transporting by means of said second transport device said single rows of articles, one-by-one against a stop adjusting the width of the feed opening and the width of the articles in a single row of articles being fed through the feed opening, the single row of articles, when transported against the stop, hitting the articles of a previous row fed immediately therebefore, at a point offset from the middle line of said previous articles, and said transported articles, due to their movement, finding and occupying spaces between the articles of the previous row.

2. A device for locating articles in a scroll pattern formation, comprising a first transport device comprising a conveyor belt, a collection station arranged at one end of said first conveyor belt, a second transport device in the form of a second conveyor belt arranged perpendicularly to the first conveyor belt and just in front of the collection station, a feed opening arranged between the collection station and the second conveyor belt, a reciprocating transfer means arranged to feed articles gathered in a row at the collection station over on said second conveyor belt, said second conveyor belt being provided with a stop arranged remote from the feed opening and further with side supports, the feed opening being provided with means for adjusting the width of the feed opening in relation to said side supports, so that respective articles in adjacent row are offset with respect to each other.

3. A device as claimed in claim 2 for locating the articles in a scroll pattern formation with an equal number of articles in each row, wherein said feed opening comprises two side surfaces adjusted inwardly a distance corresponding to ¼ of the diameter of the article as compared to the side supports.

4. A device as claimed in claim 3, including a triangular filling piece fitted at one of the corners between the stop and a side support, said filling piece including means designed to guide the articles of the first row in a direction towards the other corner between the stop and the other side support.

5. A device as claimed in claim 2 for locating the articles in a scroll pattern formation with an equal number of articles in every second row, wherein one side surface of the feed opening comprises a movable stop member, arranged to release the feed opening in a first, retracted position and which, in its second, extended position, is located inside one of the side supports a distance corresponding to half the diameter of one of the articles.

* * * * *